US009752394B2

(12) United States Patent
Webb et al.

(10) Patent No.: US 9,752,394 B2
(45) Date of Patent: Sep. 5, 2017

(54) DIE HOLDER DEVICE AND METHOD FOR UTILIZING THE SAME

(71) Applicant: National Oilwell Varco Norway AS, Kristiansand S (NO)

(72) Inventors: Jonathan Garrick Webb, Kristiansand (NO); Hugo Leonardo Rosano, Kristiansand (NO); David Allen Hill, Kristiansand (NO); Trond Werner Moen, Kristiansand (NO)

(73) Assignee: NATIONAL OILWELL VARCO NORWAY AS, Kristiansand S (NO)

( * ) Notice: Subject to any disclaimer, the term of this patent is extended or adjusted under 35 U.S.C. 154(b) by 263 days.

(21) Appl. No.: 14/403,860

(22) PCT Filed: May 29, 2013

(86) PCT No.: PCT/NO2013/050097

§ 371 (c)(1),
(2) Date: Nov. 25, 2014

(87) PCT Pub. No.: WO2013/180575

PCT Pub. Date: May 12, 2013

(65) Prior Publication Data

US 2015/0144355 A1 May 28, 2015

(30) Foreign Application Priority Data

May 30, 2012 (NO) ..... 20120632

(51) Int. Cl.

| | |
|---|---|
| ***E21B 19/02*** | (2006.01) |
| ***B25B 5/14*** | (2006.01) |
| ***E21B 19/16*** | (2006.01) |

(52) U.S. Cl.
CPC ..... *E21B 19/02* (2013.01); *B25B 5/147* (2013.01); *E21B 19/161* (2013.01)

(58) Field of Classification Search
CPC ..... B25B 5/147; E21B 19/02; E21B 19/161
USPC ..... 166/379, 85.1
See application file for complete search history.

(56) References Cited

U.S. PATENT DOCUMENTS

| | | | | |
|---|---|---|---|---|
| 1,417,490 | A | 5/1922 | Brandon | |
| 4,649,777 | A | 3/1987 | Buck | |
| 6,263,763 | B1 | 7/2001 | Feigel, Jr. et al. | |
| 2002/0189804 | A1 * | 12/2002 | Liess | E21B 19/164 166/77.51 |

(Continued)

FOREIGN PATENT DOCUMENTS

| | | | |
|---|---|---|---|
| GB | 2348844 | A | 10/2000 |
| NO | 309129 | B1 | 12/2000 |
| NO | 20092552 | A | 1/2011 |

OTHER PUBLICATIONS

PCT/NO2013/050097 International Search Report and Written Opinion dated Oct. 15, 2013 (9 p.).

*Primary Examiner* — Taras P Bemko
(74) *Attorney, Agent, or Firm* — Conley Rose, P.C.

(57) ABSTRACT

A die holder device includes a die holder that has an axial centre line and is adapted to receive a clamp die. The die holder is included in a clamp arm or slide block. The die holder is restricted from axial movement by at least a first complete or partial conical surface and possibly by a second complete or partial conical surface that directly or indirectly bears against the clamp arm or the slide block.

21 Claims, 2 Drawing Sheets

I-I

II-II

(56) References Cited

U.S. PATENT DOCUMENTS

| | | | |
|---|---|---|---|
| 2005/0034566 | A1 | 2/2005 | Bangert |
| 2010/0187740 | A1 | 7/2010 | Orgeron |

* cited by examiner

I–I

II-II

DIE HOLDER DEVICE AND METHOD FOR UTILIZING THE SAME

CROSS-REFERENCE TO RELATED APPLICATIONS

This application is a 35 U.S.C. §371 national stage application of PCT/NO2013/050097 filed May 29, 2013 and entitled "A Die Holder Device for Oilfield Use and Method for Utilizing the Same," which claims priority to Norwegian Application No. 20120632 filed May 30, 2012 and entitled "A Die Holder Device for Oilfield Use and Method for Utilizing the Same," both of which are hereby incorporated herein by reference in their entirety for all purposes.

STATEMENT REGARDING FEDERALLY SPONSORED RESEARCH OR DEVELOPMENT

Not applicable.

BACKGROUND

Field of the Disclosure

The disclosure relates generally to die holder devices. More particularly, the disclosure relates to die holder devices for clamping devices particularly used in oilfield operations and to methods of gripping oilfield components (e.g. pipe). Still more particularly, the present disclosure relates to a die holder device configured to couple a clamp die to a clamp arm or slide block of a clamping device such as a power tong.

Background to the Disclosure

The areas of interface between a die and a clamp arm or slide block fixture is generally an area subjected to substantial loadings and multiple load cycles. Industry standard dies often have dovetail cross section. The dovetail corners are generally areas where material stress and fatigue are of particular concern.

The clamp arms and slide blocks will typically be highly loaded parts cast, forged, or machined from high strength materials. The fabrication and replacement costs for clamp arms and slide blocks may therefore be relatively high.

The purpose of the disclosure is to overcome or reduce at least one of the disadvantages of the prior art by the features as disclosed in the description below and in the following patent claims.

SUMMARY OF THE DISCLOSURE

In an exemplary embodiment, there is provided a die holder device for oilfield use in which a die holder has an axial centre line and is adapted to receive a clamp die. The die holder is included in a clamp arm or slide block, wherein the die holder is restricted from axial movement by at least a first conical surface or a second conical surface that directly or indirectly bears against the clamp arm or the slide block.

By utilizing at least one conical surface for restricting the axial movement of the die holder relative to the clamp arm or slide block, a no-clearance fit in a radial direction also may be achieved between the die holder and the clamp arm or slide block by use of relatively simple means that are explained more fully below.

In various embodiments, The clamp arm or slide block has conical surfaces complementary to a first conical surface and to a second conical surface of the die holder.

The first conical surface and the second conical surface may oppose each other in order to achieve the best possible connection between the die holder and the clamp arm or slide block.

The first conical surface may be positioned at a first end portion of the die holder while the second conical surface may be positioned at a second end portion of the die holder.

For improved stability of the connection between the die holder and the clamp arm or slide block, it is advantageous to have the two conical surfaces spaced as far apart as possible.

The second conical surface may be positioned on a clamp element that is connected to the die holder. The clamp element may be tightened in the axial direction relative the die holder to achieve a satisfactory pretension of the die holder.

The clamp element may have the form of a nut that is threaded on the die holder.

At least some embodiments include a strut having a centerline and spanning between the die holder and an actuator of the die holder. The strut has a connection to the die holder that renders the strut tiltable relative the die holder. For at least one position within the working range of the die holder, the axial centre line of the die holder may have the same direction as an axial centre line of the strut. At such a position, the full clamping force from the actuator is transferred to the die, and only negligible forces from the actuator are transferred into the clamp arm or slide block. With respect to the slide block this situation may always be present, while the hinge action of the clamp arm will swing the centre line of the die holder somewhat out-of-alignment relative the centre line of the strut over the working range of the clamp arm.

Clamp forces are not taken through the clamp arm or slide block material, an arrangement that beneficially results in reduced stresses. The clamp arm or slide block holding the die holder is thus substantially isolated from the forces transferred from the actuator to the die.

For at least one position within the working range of the die holder, the axial centre line of the die holder may coincide with the axial centre line of the strut between the die holder and the actuator of the die holder. Such a situation is readily achievable for the die holder in the slide block.

In another exemplary embodiment, there is provided a method for utilizing a die holder device for oilfield use where a die holder, that has an axial centre line, is adapted to receive a clamp die and wherein the die holder is included in a clamp arm or slide block. The method includes restricting the die holder from axial movement by letting at least a first conical surface or a second conical surface bear directly or indirectly against the clamp arm or the slide block.

The method may further include letting the first conical surface and the second conical surface oppose each other.

The method may further include letting the second conical surface be positioned on a clamp element that is connected to the die holder.

The method may further include letting the clamp element be screwable on the die holder.

The method may further include letting the axial centre line of the die holder have the same direction as an axial centre line of a strut between the die holder and an actuator of the die holder, for at least one position within the working range of the die holder.

The method further may include letting the axial centre line of the die holder coincide with the axial centre line of the strut between the die holder and the actuator of the die holder, for at least one position within the working range of the die holder.

The separate die holder allows replacement of highly loaded parts without the cost of complete clamp arm or slide block replacement. It also provides for quick swap of die types because the anchor point for the die is in the exchangeable die holder.

BRIEF DESCRIPTION OF THE DRAWINGS

Exemplary embodiments of a device and method are explained in reference to the enclosed drawings, where.

DETAILED DESCRIPTION OF THE DISCLOSED EMBODIMENTS

There is provided herein a die holder device that has particular applicability to oilfield use. The die holder device includes a die holder that has an axial centre line (equivalently, "centerline") and is adapted to receive a clamp die. Within the die holder device, the die holder is included in a clamp arm or slide block. This disclosure also includes a method for utilizing the die holder device.

Figure 1:
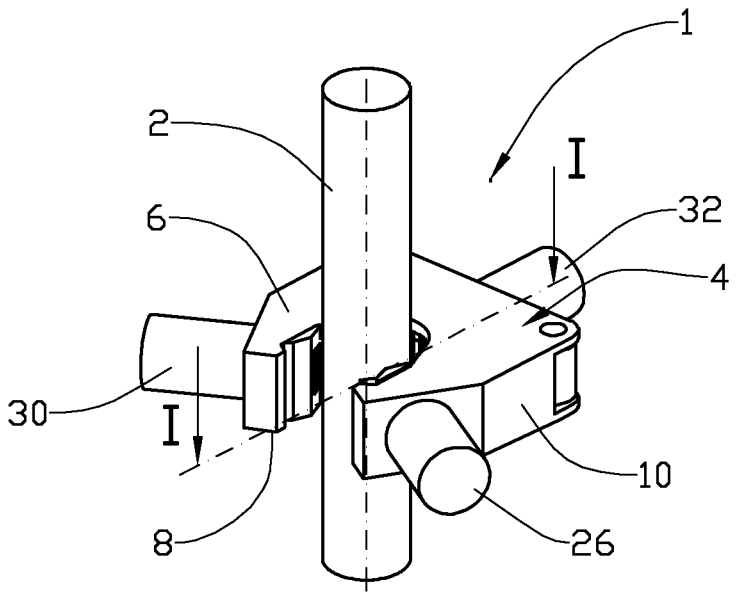
FIG. 1 shows in perspective a power tong having die holders according to the present disclosure.
Figure 2:
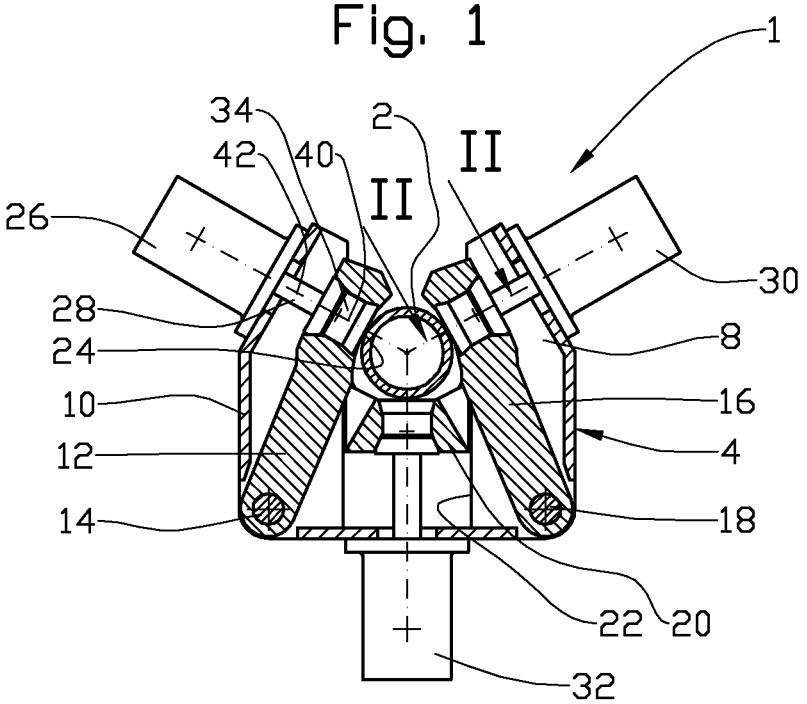
FIG. 2 shows a section I-I from FIG. 1.

In the drawings, the reference number 1 denotes a power tong that is gripping a pipe 2. In FIGS. 1 and 2, the power tong 1 is shown without various fixings, such as power and control lines that are well known to a person skilled in the art.

The tong 1 has a body 4 that is made up of an upper part 6 and a lower part 8. The upper and lower parts 6, 8 are spaced apart and joined by side parts 10. Upper and lower refers to operational positions of the tong 1.

Referring to FIG. 2, the tong 1 has a first clamp arm 12 that is hinged on a first pivot pin 14, a second clamp arm 16 that is hinged about a second pivot pin 18 and a slide block 20 that is movable in a slide 22 in the body 4. Both the pivot pins 14, 18 are fixed in the body 4.

The first and second clamp arms 12, 16 and the slide block 20 each carry a die 24 that is designed to grip the pipe 2.

In one embodiment the first clamp arm 12 is connected to a first clamp actuator 26 via a "dog bone" formed strut 28. Similarly, the second clamp arm 16 and the slide block 20 are connected to a second clamp actuator 30 and a third clamp actuator 32 respectively.

The clamp actuators 26, 30, 32 are designed to move their respective first clamp arm 12, the second clamp arm 16, and the slide block 20 within their working range from a retracted idle position to an extended active position where the dies 24 may grip a pipe 2 of sizes within the designed range of the tong 1. In FIG. 2 the tong 1 is in an activated position.

Figure 3:
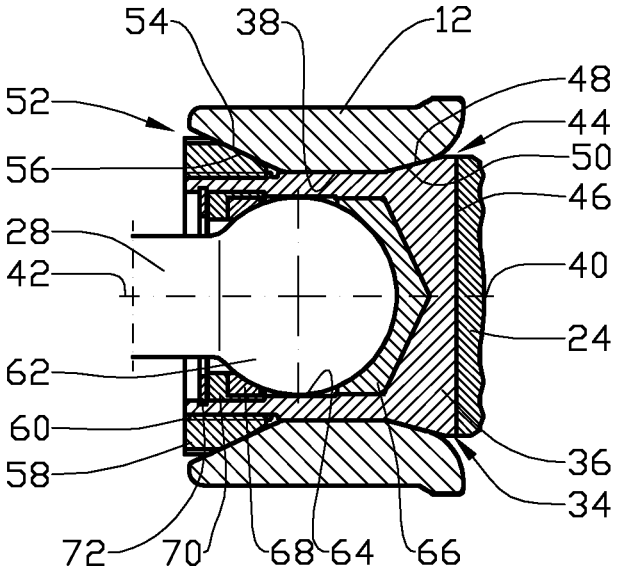
FIG. 3 shows an enlarged view of section II-II from FIG. 2.

Each die 24 is fixed to a die holder 34. A section of the die holder 34 that is positioned in the first clamp arm 12 is shown in FIG. 3. The die holders 34 of the second clamp arm 16 and the slide block 20 may preferably be of the same design as the die holder 34.

The die holder 34 has a cylindrical housing 36 that extends in a through-going bore 38 in the first clamp arm 12. At its first end portion 44 of the die holder 34 where the die 24 is connected via a dovetail connection 46, the die holder 34 has an outside first conical surface 48 facing away from the first end portion 44. The first conical surface 48 bears against an arm first conical surface 50.

At a second end portion 52 of the die holder 34, an outside second conical surface 54 that faces away from the second end portion 52 bears against an arm second conical surface 56. The second conical surface 54 is part of a nut 58 that is fixed to the die holder 34 via threads 60. The orientation of the first and second conical surfaces 50, 54 is chosen to give as straight a line as possible between an axial centre line 40 of the die holder 34 and an axial centre line 42 of the strut 28.

The first and second conical surfaces 50, 54 may be in the form of a complete or partial conical surface.

The strut 28 has a spherical end portion 62. The end portion 62 is positioned in a bore 64 in the die holder 34 between a main bearing 66 and a return bearing 68. The return bearing 68 is kept in position by a support ring 70 and a lock ring 72.

Tightening the nut 58 to give the die holder 34 a desired pretension will keep the complementary conical surfaces 48, 50 and 54, 56 in contact and prevent loosening of the nut 58. Tangential forces originating from the die 24 acting on said conical surfaces 48, 50, 54, 56 will provide compression between the die holder 34 and the first clamp arms 12, 16 or the slide block 20 without any movement between the die holder 34 and the respective clamp arms 12, 16, or slide block 20. The feature is configured to maintain steady contact under load and to reduce stress concentrations in the respective clamp arms 12, 16 or slide block 20.

The invention claimed is:

1. A die holder device comprising:

a die holder having an axial centre line, the die holder configured to receive a clamp die; and a clamp arm or a slide block in which the die holder is positioned;

wherein the die holder comprises at least one conical surface matching with and complementary fitting to a conical surface on the clamp arm or slide block, the complementary fitting conical surfaces configured to restrict the die holder from axial movement;

wherein the at least one conical surface of the die holder is an axially extending annular surface disposed about the axial centre line;

wherein the conical surface on the clamp arm or slide block is an axially extending annular surface disposed about the axial centre line.

2. The die holder device according to claim 1, wherein the die holder is formed with a first conical surface and a second conical surface;

wherein the first and second conical surfaces of the die holder fit complementarily to a first conical surface and a second conical surface, respectively, on the clamp arm or on the slide block.

3. The die holder device according to claim 2, wherein the first conical surface and the second conical surface oppose each other.

4. The die holder device according to claim 3, wherein the first conical surface is positioned at a first end portion of the die holder.

5. The die holder device according to claim 4, wherein the second conical surface is positioned at a second end portion of the die holder.

6. The die holder device according to claim 2, wherein the second conical surface is positioned on a clamp element that is connected to the die holder.

7. The die holder device according to claim 6, wherein the clamp element is a nut.

8. The die holder device according to claim 2 further comprising a strut having an axial centre line and spanning between the die holder and the die holder actuator;

wherein the axial centre line of the die holder is co-axially aligned with an axial centre line of the strut for at least one position of the die holder within the working range of the die holder and the actuator.

9. The die holder device according to claim 8, wherein the axial centre line of the die holder coincides with the axial centre line of the strut for at least one position of the die holder within the working range of the die holder and the actuator.

10. A method for utilizing a die holder device, the method comprising:

providing a die holder positioned in a clamp arm or a slide block, wherein the die holder has an axial centre line; and restricting the die holder from axial movement relative to the clamp arm or the slide block by bearing a conical surface on the die holder against a matching complementary fitting conical surface on the clamp arm or the slide block, wherein the conical surface on the die holder is an axially extending annular surface disposed about the axial centre line and the conical surface on the clamp arm or slide block is an axially extending annular surface disposed about the axial centre line.

11. The method according to claim 10 further comprising:

providing a second conical surface on the die holder; and letting the first conical surface on the die holder and a second conical surface on the die holder oppose each other.

12. The method according to claim 11 further comprising:

letting the second conical surface be positioned on a clamp element that is connected to the die holder.

13. The method according to claim 12 further comprising:

coupling the clamp element to the die holder by threads.

14. The method according to claim 11 further comprising:

disposing a strut between the die holder and an actuator of the die holder;

aligning the axial centre line of the die holder in the same direction as an axial centre line of the strut for at least one position of the die holder within the working range of the die holder and the actuator.

15. The method according to claim 14 further comprising:

aligning the axial centre line of the die holder to coincide with the axial centre line of the strut for at least one position of the die holder within the working range of the die holder and the actuator.

16. The method according to claim 10 further comprising:

disposing a strut between the die holder and an actuator of the die holder;

coupling the die actuator to a power tong body; and coupling the clamp arm or the slide block to the power tong body for movement relative to the power tong body.

17. A die holder device, the die holder device comprising:

a clamp arm or a slide block having a through-bore with an inside first conical surface;

a die holder having a cylindrical housing, a first end portion, a second end portion, a die holder bore extending through the second end portion, an outside first conical surface facing away from the first end portion, the cylindrical housing extending into the through-bore of the clamp arm or the slide block;

a clamp die coupled to the die holder and positioned adjacent the first end portion; and a die actuator coupled to the die holder and positioned opposite the clamp die;

wherein the outside first conical surface of the die holder engages the inside first conical surface of the clamp arm or the slide block.

18. The die holder device of claim 17 further comprising:

a main bearing insert positioned in the die holder bore and adjacent the first end portion of the die holder;

a return bearing positioned in the die holder bore and adjacent the second end portion of the die holder, opposite the main bearing; and a portion of a sphere coupling the die actuator to the die holder and positioned between the main bearing and the return bearing in die holder bore for rotational motion between the two bearings;

wherein the return bearing is annular and is retained in position by a support ring and a lock ring coupled to the cylindrical housing of the die holder.

19. The die holder device of claim 18 further comprising:

a strut coupled between the die holder and the die actuator;

wherein the portion of the sphere is an end portion of the strut and the strut further includes an elongate portion extending from the spherical portion toward the die actuator.

20. The die holder device of claim 19 wherein the die holder further includes a clamp element coupled to the die holder housing and having an outside second conical surface, the outside second conical surface positioned adjacent the second end portion of the die holder and facing a direction opposing the outside first conical surface;

wherein the through-bore of the clamp arm or the slide block further includes an inside second conical surface configured to engage the outside second conical surface of the clamp element.

21. The die holder device of claim 17 wherein the die holder further includes a nut threadingly coupled to the die holder housing and having an outside second conical surface, the outside second conical surface positioned adjacent the second end portion of the die holder and facing a direction opposing the outside first conical surface; and wherein the through-bore of the clamp arm or the slide block further includes an inside second conical surface configured to engage the outside second conical surface of the clamp element.

* * * * *